US006216471B1

(12) United States Patent
Patrick et al.

(10) Patent No.: US 6,216,471 B1
(45) Date of Patent: Apr. 17, 2001

(54) METHOD AND APPARATUS FOR PROVIDING ICE

(75) Inventors: Kenneth H. Patrick, Rainbow City; Thomas A. Mooty; Larry E. Unger, both of Southside, all of AL (US)

(73) Assignee: Mid-South Industries, Inc., Gadsden, AL (US)

( * ) Notice: Subject to any disclaimer, the term of this patent is extended or adjusted under 35 U.S.C. 154(b) by 0 days.

(21) Appl. No.: 09/175,070

(22) Filed: Oct. 19, 1998

Related U.S. Application Data

(62) Division of application No. 08/547,522, filed on Oct. 24, 1995, now Pat. No. 5,823,001.

(51) Int. Cl.[7] ..... F25C 1/12
(52) U.S. Cl. ..... 62/71; 62/353
(58) Field of Search ..... 62/71, 300, 353

(56) References Cited

U.S. PATENT DOCUMENTS

| | | | | |
|---|---|---|---|---|
| 2,435,102 | * | 1/1948 | Rundell et al. | 62/300 |
| 3,002,363 | * | 10/1961 | Harle et al. | 62/300 |
| 3,727,428 | * | 4/1973 | Linstromberg | 62/300 |
| 4,679,718 | | 3/1987 | Lindstromberg | 62/233 |
| 4,680,943 | * | 7/1987 | Mawby et al. | 62/300 |
| 4,754,615 | * | 7/1988 | Linstromberg | 62/300 |
| 4,838,026 | * | 6/1989 | Searl | 62/353 |
| 5,056,321 | | 10/1991 | Patrick | 62/73 |
| 5,056,322 | | 10/1991 | Patrick | 62/73 |
| 5,212,955 | | 5/1993 | Hogan | 62/73 |
| 5,329,786 | * | 7/1994 | Willis et al. | 62/353 |
| 5,675,975 | | 10/1997 | Lee | 62/353 |

* cited by examiner

*Primary Examiner*—William E. Tapolcal
(74) *Attorney, Agent, or Firm*—Alston & Bird, LLP

(57) ABSTRACT

An icemaking assembly ("icemaker") is provided which includes an improved construction including an ice mold separate but attached to a structural base. The structural base includes integral elements such as a water fill cup, stripper, and mounting configuration. The integral nature of the stripper, combined with its "living hinge" feature, allows for an improved method and apparatus for fixing the ice tray in place. The combination provides an icemaker having improved thermal properties, as well as improved manufacturing efficiencies. Other improvements include an improved control system, as well as other cost-saving features.

3 Claims, 12 Drawing Sheets

SWITCH STATE DIAGRAM FOR CURRENTLY AVAILABLE ICEMAKERS

SWITCH STATE DIAGRAM FOR NEW CONTROL CIRCUIT

METHOD AND APPARATUS FOR PROVIDING ICE

CROSS-REFERENCE TO RELATED APPLICATIONS

This is a divisional of a previous application Ser. No. 08/547,522, filed Oct. 24, 1995, issued on Oct. 20, 1998, as U.S. Pat. No. 5,823,001.

TECHNICAL FIELD

This invention relates in general to the making of ice, and particularly relates to a method and apparatus for making ice which is suitable for use in conventional consumer refrigerators, and which has low power requirements.

BACKGROUND OF THE INVENTION

It is generally well known to provide ice making apparatuses (also referred to as "icemakers") for use in the freezer compartments of residential refrigerators. Examples of such icemakers are shown or otherwise disclosed in U.S. Pat. No. 5,212,955 to Hogan.

Icemakers such as known in the prior art use an aluminum ice mold as a structural member that provides mounting for separate elements such as an ice stripper and a water fill cup. These additional functions add mass and complexity which makes the ice mold one of the most expensive parts on the unit. In addition, the extra mass acts as a heat sink slowing temperature changes within the icemaker and slowing freezing and heating (for ice release).

Some prior art icemaker designs use separate molded fill cups to deliver water to the ice mold. However, the additional part adds material and labor cost to the product and adds assembly tolerance to the positioning of the water tube interface.

Some prior art designs also use separate molded ice strippers to remove the ice from the ejector after it has been swept from the ice mold. Ice strippers prevent the ice pieces from re-entering the ice mold. Such use of an additional part adds material and labor cost to the product and adds assembly tolerance to the positioning of the stripper.

In the current prior art, depending on brand and model, there are two distinct hole patterns for mounting the icemaker to the interior of the freezer, and different locations for the positioning of water fill tubes. This makes packaging of a single icemaker to fit all units difficult.

Some prior art icemakers also use a relatively complex circuit (see FIG. 7) which relies on double throw switches, and which has numerous connections. The circuit operates as follows (see FIG. 5 for state diagram):

1. A thermostat closes at a set temperature, beginning the cycle by energizing the heater and the motor.

2. A motor drives a cam which closes a "hold switch". The hold switch continues the cycle after the thermostat opens.

3. A cam operates a "full bucket detector arm" which doubles as a shutoff. The detector arm operates the shut off switch. The shut off switch opens during the eject cycle and remains open if the bucket is full, preventing the next cycle, otherwise it closes after a short interval. The hold switch continues the cycle.

4. The "water fill switch" is closed by the timer cam, but does not energize the valve because an alternate current path through the thermostat is available. This prevents a double fill.

5. The hold switch is opened by the cam after 360° rotation, but the motor continues to run due to the closed thermostat.

6. The thermostat opens at the set temperature.

7. The shutoff switches open for a short interval.

8. The fill switch closes for the set time, energizing the water valve, filling the icemaker.

9. The hold switch opens, ending the cycle.

Most popular prior art icemakers available today use heat to release ice from the ice mold. The heating element typically used is a U-shaped tubular heater staked into a die cast ice mold. This type of element adds length to the unit (to provide for the U bend), adds material to the ice mold (for its mounting), requires high wattage (due to the mass and distance from ice), and tends to produce uneven heating. In addition, the tubular heater typically restricts the ice mold design to a die casting to allow mounting.

Prior art icemakers have arcuately shaped ice molds to provide ejection by means of a rotating arm which rotates about the center of the ice piece radius. The ice is formed in a die-cast aluminum mold body which has draft in the direction of die opening to allow ease of part removal. This draft in one direction creates an interference when the wider ice piece top rotates into the narrower bottom. More time and heat is required to melt the interference and eject the part. Prior art ice piece shapes tend to disadvantageously conform to the interior side of drinking glasses, creating a "damming" effect which is a nuisance to the consumer.

Prior art icemakers typically use a thermostat to detect completely frozen ice to start an ejection cycle. The thermostat is typically located on one end of the ice mold and attached by mechanical means such as screws and clamps. Good thermal coupling between the thermostat and the ice mold is essential to proper ice detection; therefore, a thermal paste is added between the parts. Some mounting schemes can allow some gaps or uneven pressure between the ice mold and the thermostat, causing premature cycling. The mechanical mounting means also require hardware and labor to attach the thermostat.

Prior art designs have used a gear-motor to drive a gear which attached to a cam to drive the ejector shaft. The rotating ejector shaft sweeps the ice out of its arcuately shaped mold and into the storage bin. The cam controls the time of the water fill by actuating a switch. The inherent gear mesh and cam fit-up tolerances can result in unacceptable water fill cycle tolerances. Excessive fill can lead to spillage or oversized ice pieces which will not fit through available ice dispensers.

Therefore, it may be seen that although the prior art has advantages, it likewise includes many disadvantages, not the least being a propensity towards complexity. As complexity tends to relate to high material, labor, and production costs, obviously there is a need to provide an icemaker which is simple in design and operation, yet suitable for use in the residential environment (e.g., reliable, and safe).

SUMMARY OF THE INVENTION

The present invention overcomes deficiencies in the prior art by providing an improved icemaker configuration which is simple yet effective in design and operation, thus providing a reliable icemaker which can be produced at lower cost to the consumer.

One improved feature is the use of an ice mold member which has reduced mass and complexity, yet incorporates as many required functions as possible for further cost reduction and assembly improvements. For example, the icemaker base can include an integral ice cup, an integral stripper element, and an universal mounting configuration. By providing a ice tray member having reduced mass, improved heat transfer is provided, assisted by the use of flexible heating elements which may be attached in an improved manner by the use of adhesive. The icemaker design also includes a control configuration which requires only one rotation of the ejector per machine cycle.

Generally described, the invention relates to the use of a structural base member, which supports a separate ice mold element.

Therefore, it is an object of the present invention to provide an improved icemaker.

Therefore, it is an object of the present invention to provide an improved icemaker suitable for use in a conventional residential refrigerator.

It is a further object of the present invention to provide an icemaker which includes the use of a low wattage heater which is cost-efficient to use, and tends to provide less risk of damage due to excessive heat.

It is a further object of the present invention to provide an icemaker having a ice tray with reduced mass and complexity to minimize cost and icemaking cycle time.

It is another object of the present invention to provide an icemaker which incorporates as many functions as possible into the structural member for further cost reduction and assembly improvement.

It is another object of the present invention to provide means for delivering water from the refrigerator supply tube to an icemaker mold without requiring the use of a separate part.

It is another object of the present invention to provide an icemaker with a universal mounting configuration.

It is another object of the present invention to provide an icemaker configuration including means for stripping ice pieces off of the ice ejector without using an additional part.

It is another object of the present invention to provide an icemaker configuration which can be mounted in any brand of refrigerator-freezer with minimal additional cost.

It is another object of the present invention to provide an icemaker configuration having an electrical control circuit which starts the cycle, energizes a motor, heater and, at the appropriate time, a solenoid valve provides water fill, and a separate means is provided for full ice bucket detection and manual shutoff.

It is another object of the present invention to provide an icemaker configuration having a heat source for releasing ice in a heat release icemaker which is easily installed, is cost effective and heats evenly.

It is another object of the present invention to provide an icemaker configuration which provides an ice piece shape which can be easily removed from the ice mold in which it is formed.

It is another object of the present invention to provide an icemaker configuration allowing for attachment of the control thermostat of an icemaker with minimum parts and labor using thermally conductive adhesives.

It is another object of the present invention to provide an icemaker configuration having means for positive ejection of ice from a crescent icemaker from the ice tray using direct drive and provide more accurate timing of the water fill cycle by using the output shaft of a gear-motor.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

General Discussion

Figure 1:
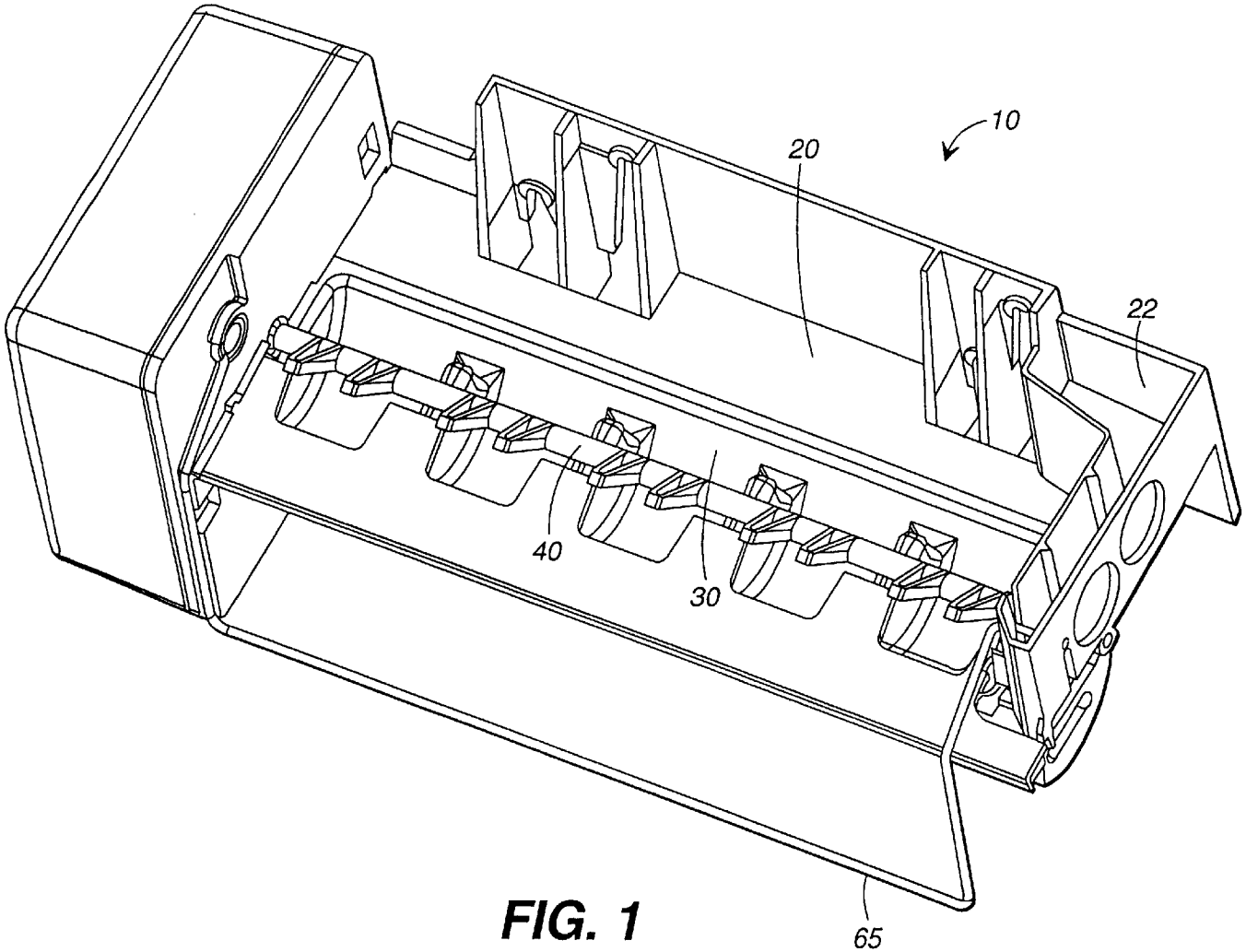
FIG. 1 is a pictorial view of an icemaker assembly 10 according to the present invention.

Referring first to FIG. 1, an icemaker assembly 10 according to the present invention generally consists of a structural base member 20 (which may also be referred to as a base 20), a separate ice mold member 30, and a separate ejector 40. Water poured into the ice mold 30 is frozen in the mold, to then be ejected from the mold while frozen by the use of the ejector 40, which rotates about the longitudinal axis of its spinelike center structural member relative to the stationary mold. The ice mold member 30 is held in place relative to the structural member 20 by use of an ice stripper 23 integrally but foldably attached relative to the structural member 20. The structural interrelationship between the structural member and the ice mold provides for improved thermal properties conducive to the efficient and reliable production of ice.

The Base

Figure 2:
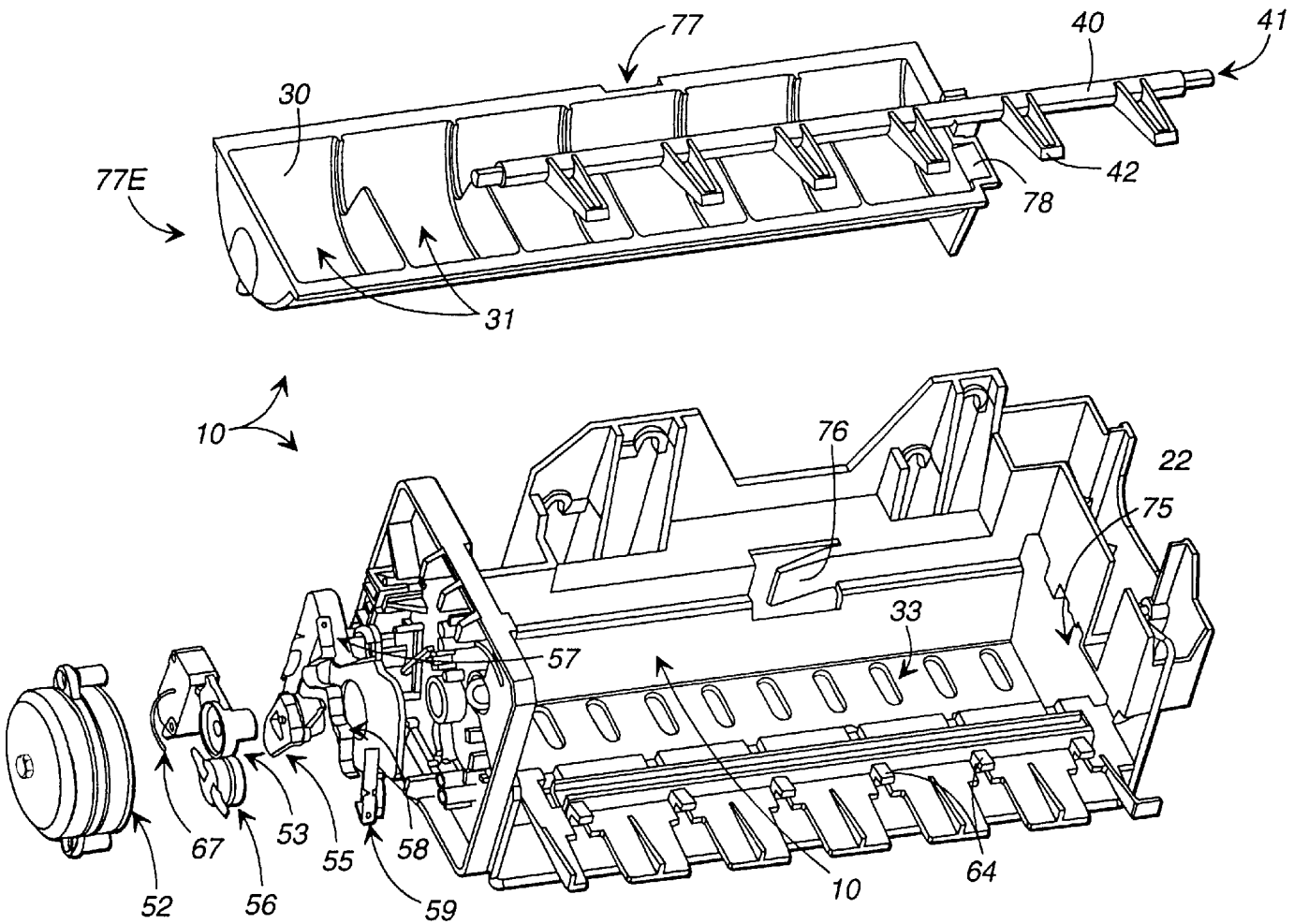
FIG. 2 is an exploded view of the icemaker assembly according to the present invention, except that a cover member is not shown.
Figure 3:
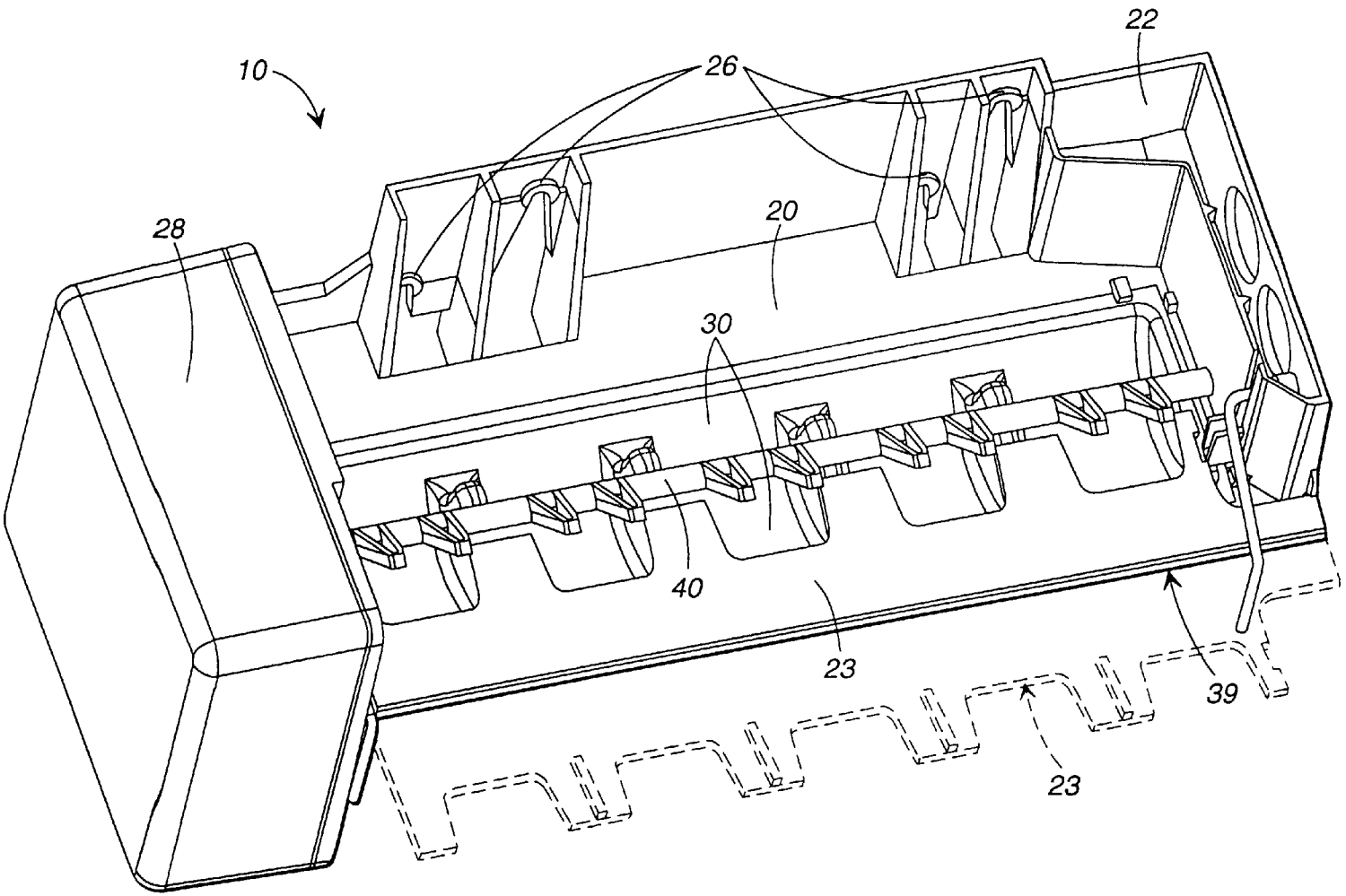
FIG. 3 is another pictorial view of an icemaker according to the present invention, with the as-molded position of the ice stripper shown in phantom.

Referring now also to FIGS. 2 and 3, the structural base 20 of the icemaker assembly 10 is configured to be attached to an interior wall of a freezer section of a conventional residential refrigerator. All other separate components of the icemaker assembly are attached relative to the structural base 20. The base 20 of the icemaker 10 itself comprises an integral water fill cup 22, an integral stripper 23, a control module portion 24, icemaker mounting geometry defining mounting holes 26 and a lower vented cover 33 (see FIG. 2) to protect a heater (see FIGS. 13A–13B) from contact from below.

The chassis-like structural base 20 has two sets of mounting holes 26 that preferably provide a suitable interface with all icemaker equipped and icemaker-ready refrigerators. Therefore it may be understood that, by using the structural base according to the present invention, an effectively "universal" icemaker may be provided for original equipment or retrofitting.

The Fill Cup

The water fill cup 22 accepts water from a fill tube, and directs and slows the flow as it cascades into the inlet trough 78 of the ice mold 30.

The water fill cup has openings that correspond with the positions of the water fill tubes on most brands and models. A flat has been added to provide a location for an additional fill tube interface to be punched. The overall dimensions of the icemaker are preferably kept within the envelope of the existing units to insure fit.

The Ice Mold

Referring now to FIG. 2, the ice mold 30 contains the water within separate partitions 31 during freezing. Passageways are provided intermediate the partitions to allow water to flow from the inlet trough 78 to the rightmost (as viewed) partition, to all of the other partitions.

Figure 9:
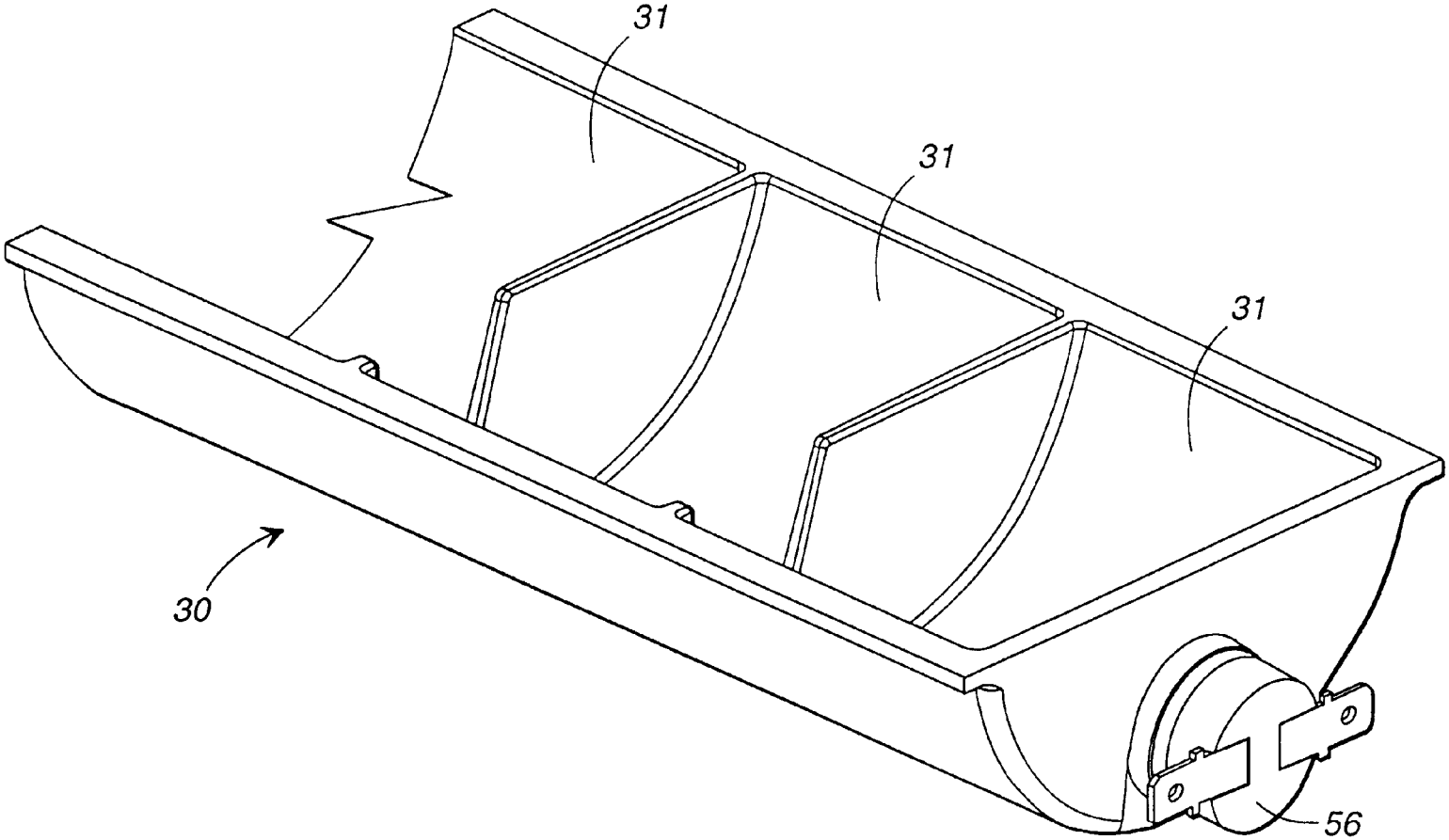
FIG. 9 is an isolated view of a portion of an ice mold according to the present invention, with a thermostat shown attached to one end thereof.
Figure 10:
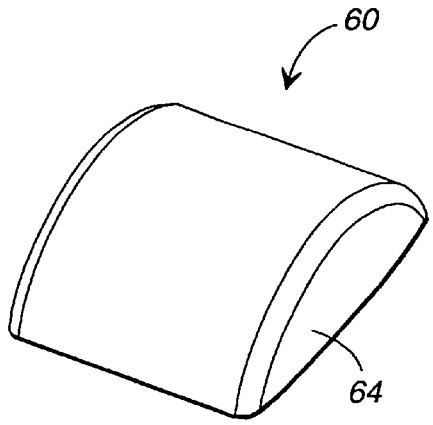
FIG. 10 is an isolated pictorial view of an ice piece according to the present invention.
Figure 11A:
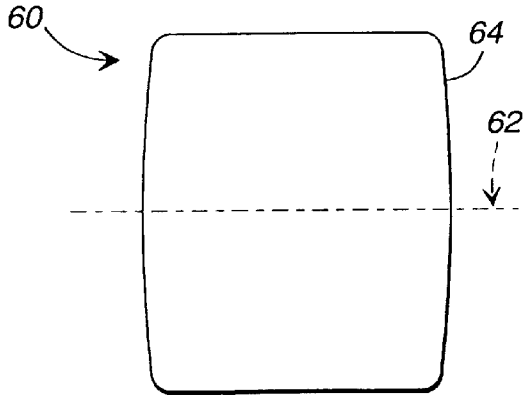
FIGS. 11A–11C are top, side and end elevational views of an ice piece according to the present invention.
Figure 11B:
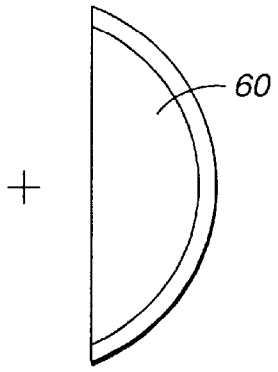
Figure 11C:
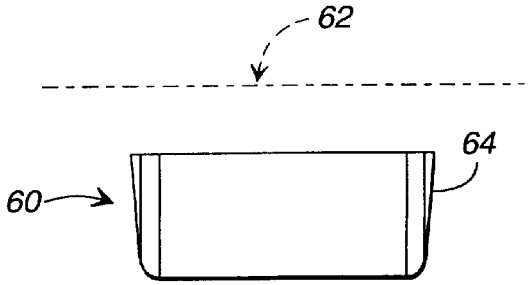
Figure 13A:
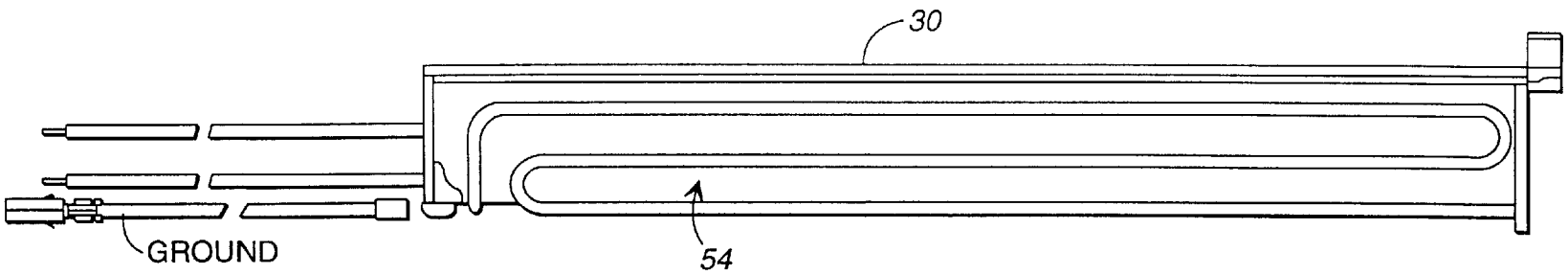
FIGS. 13A and 13B are side and top elevational views, respectively of a heater/ice mold combination according to the present invention.
Figure 13B:
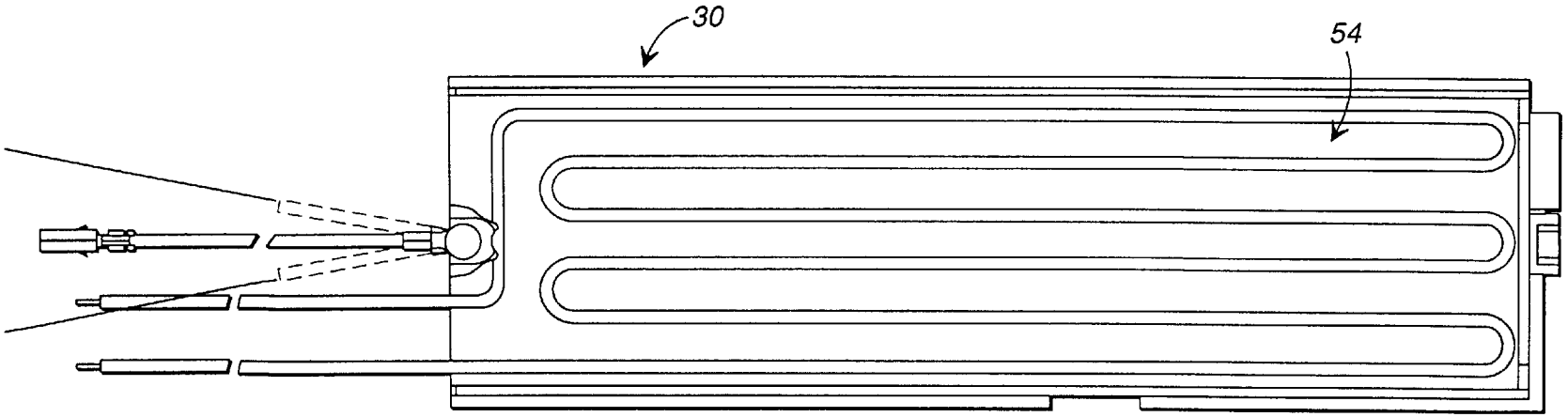

The ice mold 30 may be constructed of alloy 380 aluminum. A smooth bottom surface may be provided to allow attachment of the heater as shown in FIGS. 13A–13B. One end of the ice mold has a smooth-surfaced mounting pad to receive the thermostat as shown in FIG. 9.

The ice mold is preferably die cast aluminum, with "straight-pull" characteristics out of the mold.

When the ice mold 30 is installed, it is installed "leading" end 77E first through the hole 75 in one end of the structural base member, in a "sliding" action, until the locking finger 76 (integral with the structural base) locks into the slot 77 in the ice mold, thus locking it in place. The ice mold is thus held in place by tabs (not shown) which bias atop the leading end of the ice mold 20, is held in place by the fill cup contacting the top of the trailing (as installed) end of the ice mold, and finally is held in place by various portions of the structural base being in contact with the lower surfaces of the outwardly-extending side ledges of the ice mold 30.

The ice mold 30 may be anodized, and may also include an epoxy covering, similar to the covering used in canned beer or soft drink cans, in order to reduce the risk of foul taste.

The Ice Stripper

The stripper 23 prevents the ice from rotating back into the ice mold. The ice stripper 23 is formed by molding the shape into the chassis in a flat position, connected to the chassis by a living hinge 39. In assembly, as shown in FIG. 3, before the ice mold 30 is placed in the structural base 20, the stripper 23 is rotated from its as-molded position to its assembled position. At this point the ice mold is slid into place, where it is held by integral hook members 64 (shown in FIG. 2), which serve to "lock" the stripper 23 in place along its length. Such a configuration has been found to be advantageous in that the hooks tend to provide a relatively solid structural combination between the ice tray and the stripper.

The Heater

Figure 14:
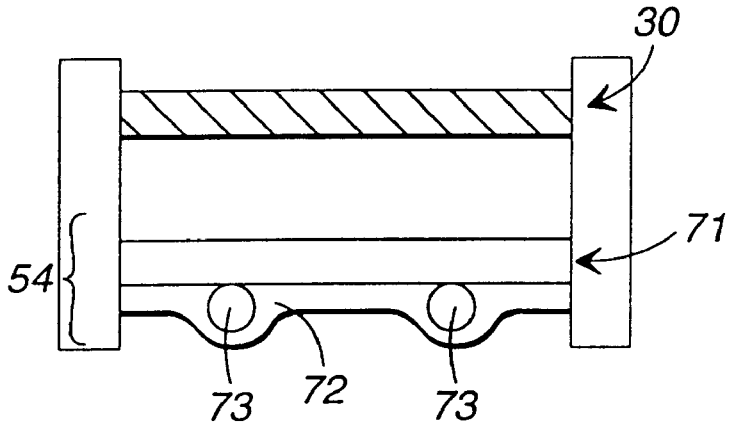
FIG. 14 shows isolated cross sections of a ice mold and a flexible heater.

Referring now to FIGS. 13A, 13B, and 14, a flexible heater 54 having three leads (line, neutral, and ground) is shown, which may be attached to the underside of the ice mold by adhesive applied to the main flexible layer 71 of the heater 54. As may be seen in FIG. 14, the heater includes a main flexible layer having adhesive applied to exposed surface 70. A flexible, serpentine heating element 73 is encapsulated between layer 71 and flexible cover layer 72. As may be understood, the heater 54 is attached with surface 70 in contact with the underside of the ice mold 30.

As may be seen, under one embodiment of the present invention, flexible heaters can be used, which allow the heater to conform to the lower, arcuate, surface of the ice mold 30. Such flexible heaters can include: laminated wire on foil, etched foil, silicone encapsulated and screened printed film. Laminated wire on foil heaters are constructed of insulated heater wire which is laminated to a foil substrate. The foil transfers the heat to the mold surface to which the heater is bonded. Etched foil heaters are made by etching resistive foil away from a film substrate. Silicone encapsulated heaters are constructed by forming a sandwich of uninsulated heater wire between two layers of silicone rubber. Under one preferred embodiment of the present invention, the flexible heaters are mounted using adhesives. However, it should be understood that the attachment means is not limited to adhesive.

As discussed above, the heater is applied to the bottom of the ice mold. All of the heater types can pattern the conductors to provide heat only on the bottom of the ice pieces to be released.

The Ejector

The ejector 40 is conventional in construction and operation, to the extent it is rotatably driven about the longitudinal axis of its spinelike central shaft 41 by a motor, such that its individual fingerlike clearing fingers 42 provide positive means for pushing the ice pieces from their corresponding as-frozen positions within their corresponding cavities within the ice mold 30.

The Motor

Under one embodiment of the present invention, the output shaft of the motor assembly attaches directly (without gear reduction) to the icemaker ejector 40. Torque is transmitted by means of an internal D-hole, spline or other torque transmitting configurations. The outside diameter of the output shaft can include one or more cam surfaces for controlling water fill cycle interval and other necessary functions as required.

The Thermostat

Referring now to FIG. 9, another aspect of the present invention relates to the use of a thermostat 56 for controlling the cycle of an icemaker held in place using a thermally conductive adhesive applied between the thermostat and the ice mold 30. Preferably, the ice mold 30 should have a locating feature for the thermostat. In assembly, the adhesive will be applied to the thermostat which will itself then be placed on the end of the ice mold 30 and clamped in place.

Control Scheme/Operation

Figure 4:
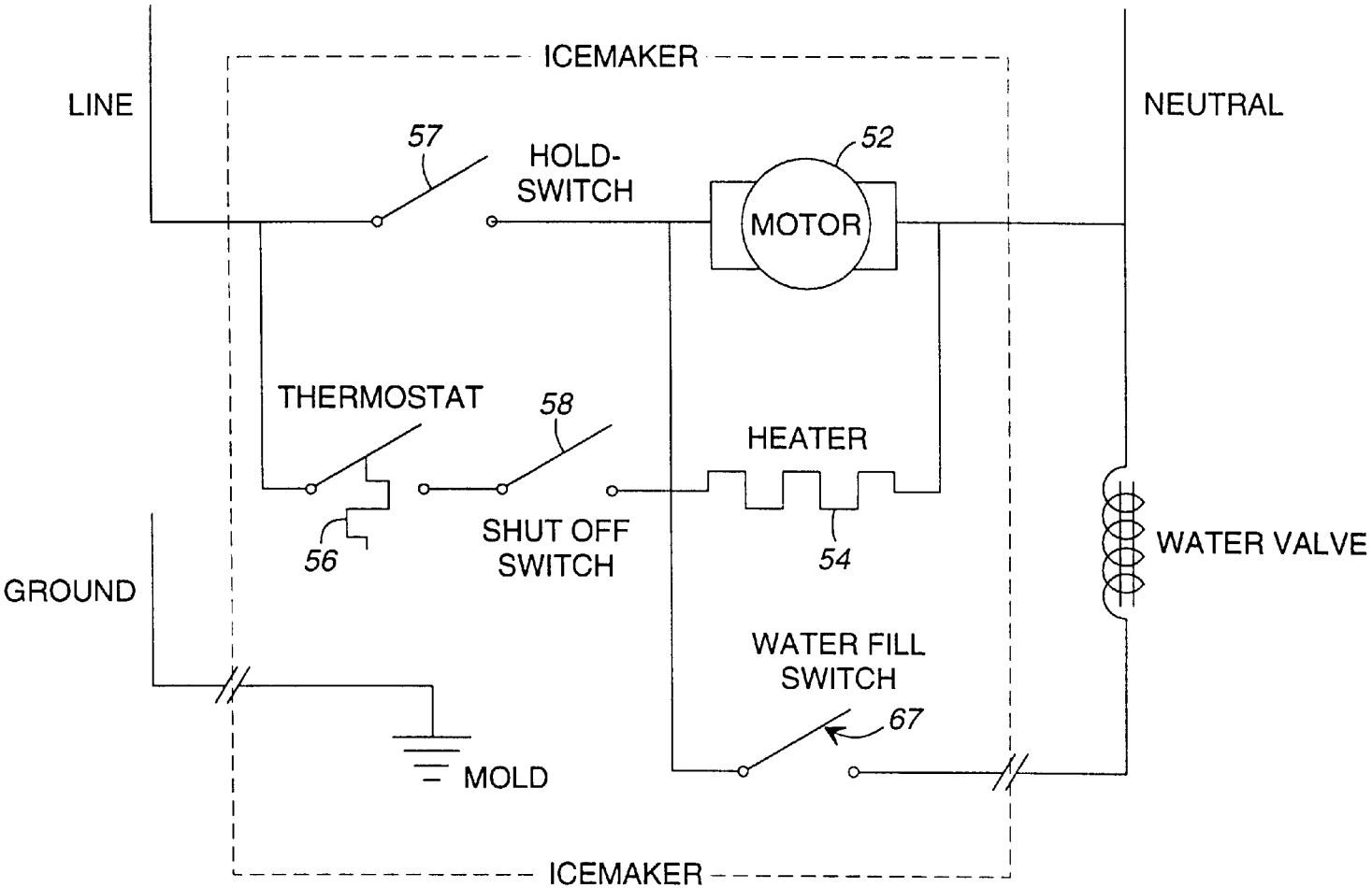
FIG. 4 is a circuit diagram of a control circuit according to the present invention.
Figure 5:
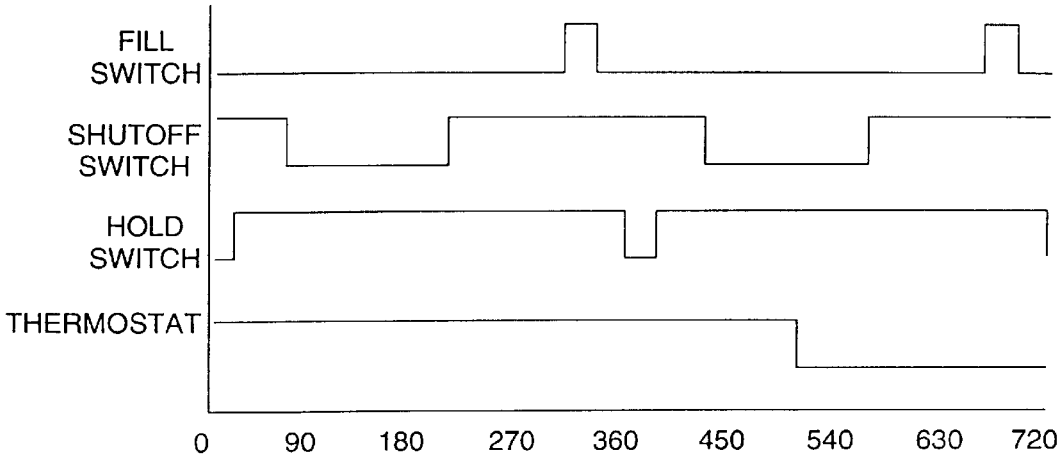
FIG. 5 is a prior art switch state diagram for prior art icemakers.
Figure 6:
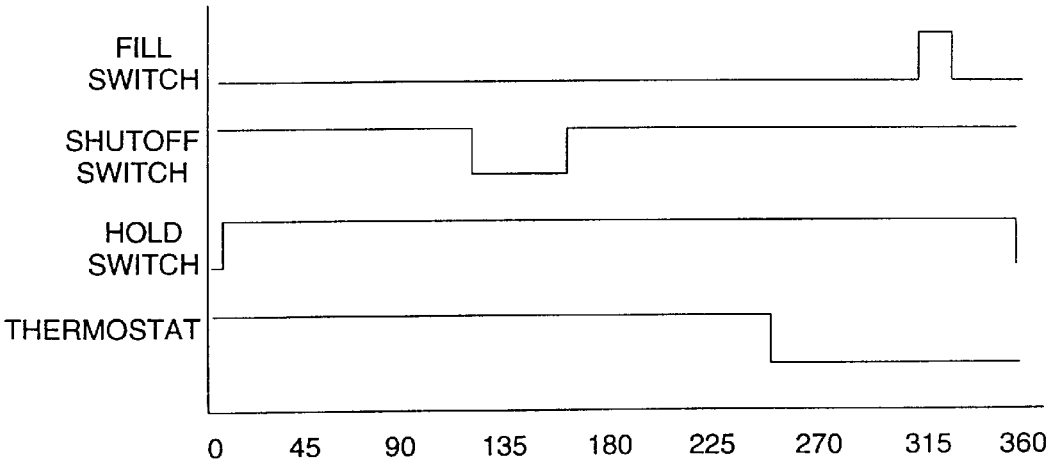
FIG. 6 is a switch state diagram according to the present invention.
Figure 7:
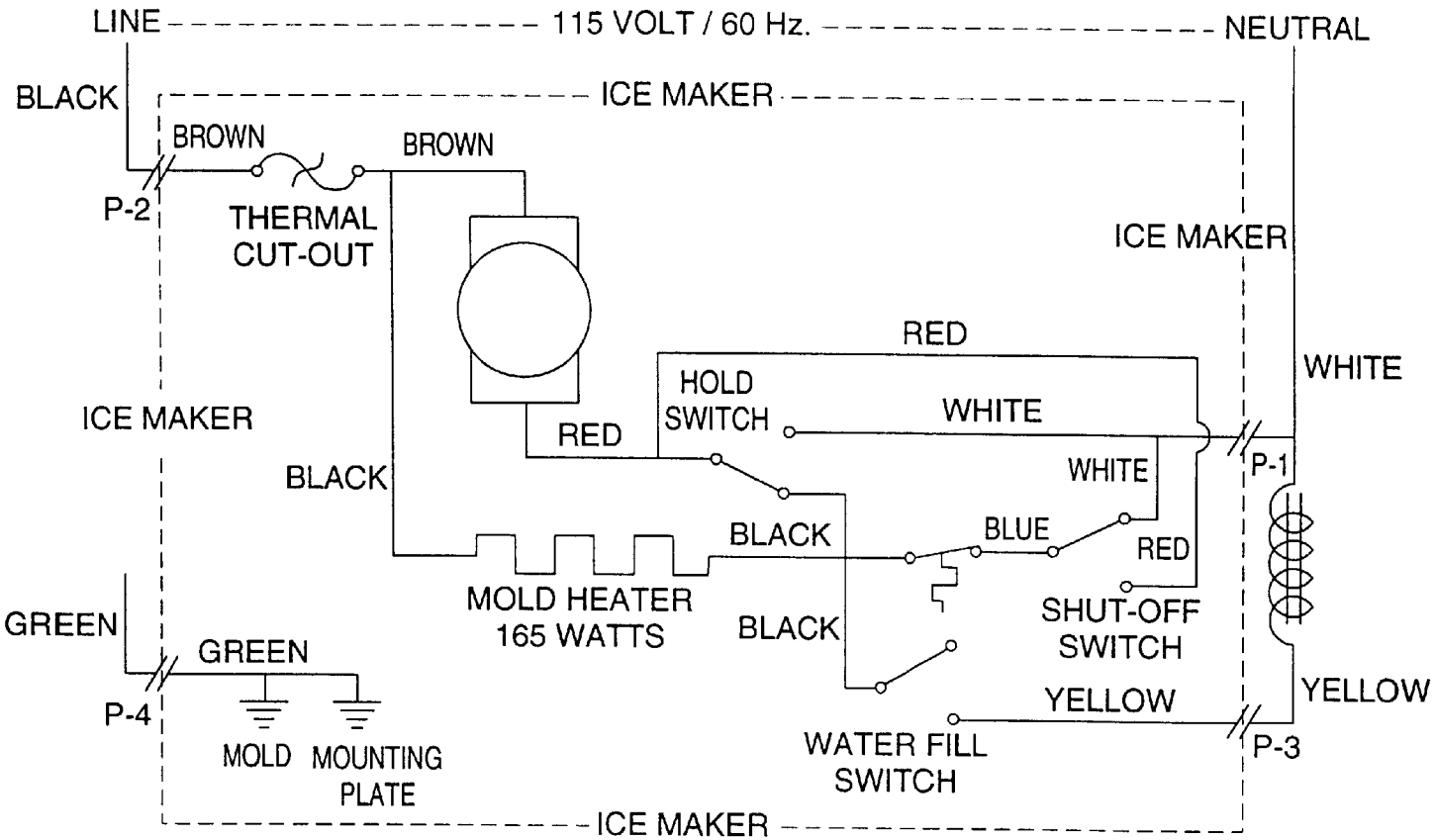
(PRIOR ART) FIG. 7
FIG. 7 is a circuit diagram illustrating the prior art.
Figure 8:
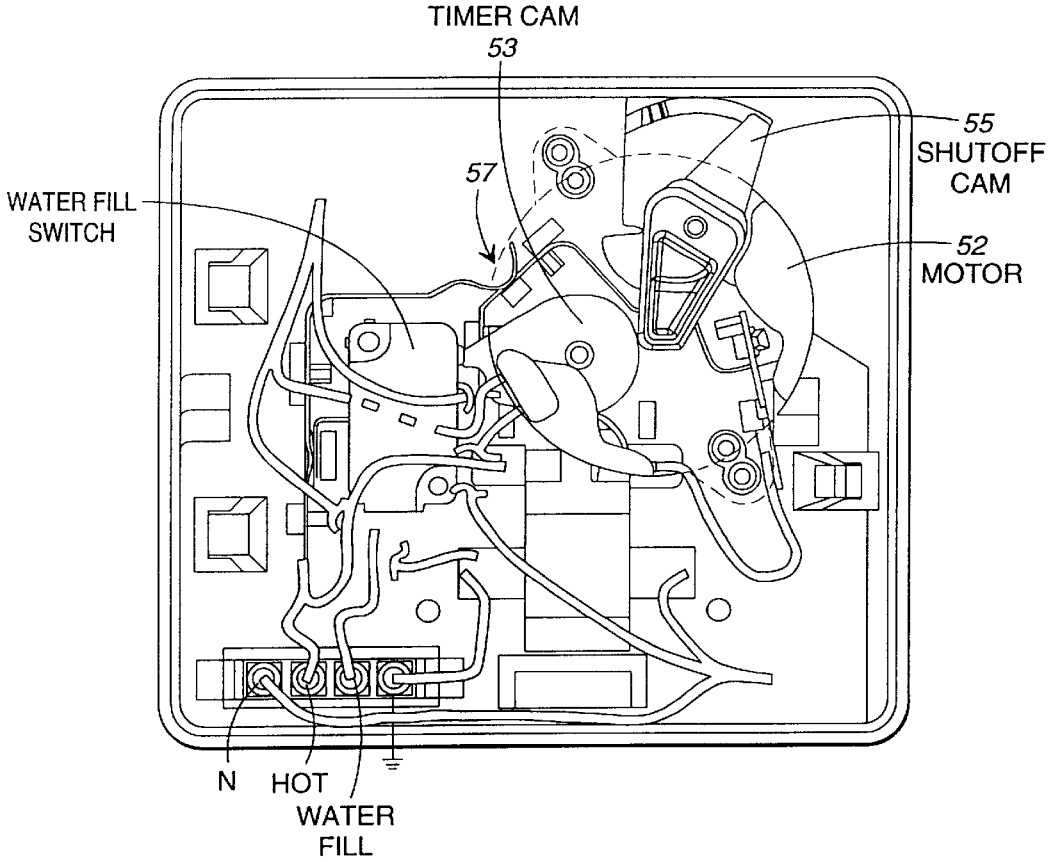
FIG. 8 is an end view of an icemaker according to the present invention, with the cover removed, illustrating control-related elements.

Reference is now also made to FIG. 4, which sets forth a portion of the circuit diagram incorporating the present invention. As may be seen, three wires having line, neutral, and ground properties lead to the circuit diagram. The dotted lines illustrate the provision of disconnect points within the circuit wiring. As may be seen, when a hold switch 57 is closed, a motor 52 and a heater 54 are energized, regardless of whether a thermostat switch 56 or a shutoff switch 58 are closed or open. As may also be seen, if the thermostat switch 56 and a shutoff switch 58 are both closed (they are in series), the motor 52 and a heater 54 are energized, regardless of whether the hold switch is closed or open.

As may also be seen by that shown in FIG. 4, if the motor 52 and heater 54 are energized, so will the water valve be energized, but only if the water fill switch 67 is closed. The mold is grounded by a third, ground wire.

Referring now also to FIGS. 6, 8, and 12A–12C, the overall operation of the control circuit is now discussed.

At the beginning of the cycle, the hold switch 57 will be assumed to be open, and the thermostat switch 56 will also be assumed to be open (as the water within the ice mold has not yet frozen).

1. The water within the ice mold freezes, causing the thermostat to close, beginning the icemaker cycle by energizing the heater 54 and the motor 52.

2. The motor 52 drives a timer cam 53 which rotates from the position shown in 12B towards that shown in FIG. 12C. This allows the hold switch 57 to close due to the resistance of the first flexible electric contact strip 48. It should be noted that the hold switch 57 will continue the cycle after the thermostat 56 opens (which occurs when new water is introduced later in the cycle).

Figure 12A:
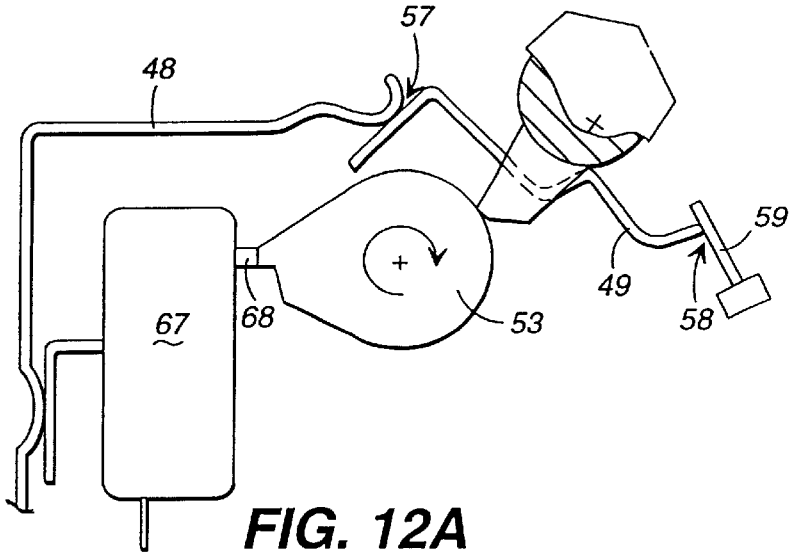
FIGS. 12A–12C are isolated partially illustrative views of a portion of the control system according to the present invention, showing the effect caused by rotation of a timer cam 53.
Figure 12B:
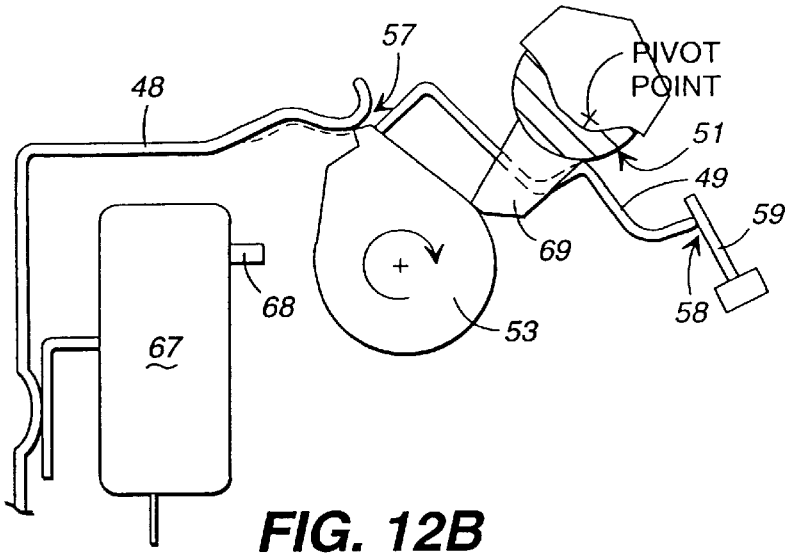
Figure 12C:
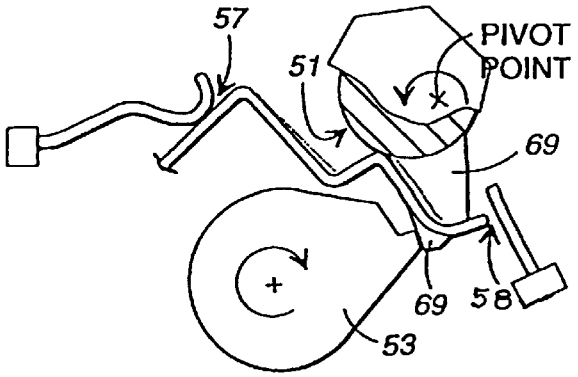

3. As the timer cam continues its rotation towards that shown in FIG. 12C, the single lobe of the timer cam contacts the trip member 69 of a shutoff cam 55. As shown in FIG. 12C, when the single lobe of the timer cam 53 contacts and moves the trip member 69, the shutoff cam 55 is pivoted towards an outermost position. In FIG. 12C, it will be assumed that the shutoff cam 55 has been pivoted as much as is possible by the timer cam 53. At such a point, the full bucket detector arm will be at its fully extended position within the ice receptacle (not shown), and a new batch of freshly frozen ice pieces will have just been ejected by the ejector. At this same point, a cam surface 51 of the shutoff cam 55 has displaced one end of a second flexible electrical contact strip 49 such that the shutoff switch 58 is open. As may be understood, if this shutoff switch is never allowed to close (e.g., if ice gets in the way of the full bucket detector arm when it returns to its spring-loaded position), the next cycle will not be allowed to occur even when the thermostat opens.

4. The thermostat 56 opens at the set temperature.

5. The "water fill switch" 67 is closed by the timer cam for the time the single lobe of the timer cam dwells on the water fill switch trigger 68, energizing the water valve (typically located remotely from the icemaking assembly), filling the icemaker. The water fill switch then opens after the trigger is released.

6. The hold switch 57 opens, ending the cycle. The next cycle will start when the thermostat closes.

The Ice Shape

The present invention also relates to the provision of an improved ice piece shape. As shown in FIGS. 10 and 11A–11C, the invention consists of an ice piece shape 60 created by a truncated revolved section having conically-shaped sides 64. The section 60 is shaped such that when it is rotated about a central axis 62, it creates draft in the direction of die opening and eliminates the interference in the direction of rotation. The revolved section is truncated at a level which allows easy ejection yet provides for water fill level tolerances. The ice piece 60 is ejected by an arm rotating about the axis 62 of the revolved section.

Alternatives

As an alternative, the stripper could be molded into the installed position in the chassis; however, in the current application, this alternative created accesses to electrical components, or additional cost.

An alternative to the use of a flexible heater is the direct application of heater material such as heating paint and thick film polymer ink to the ice mold. This would require an application of a dielectric coatings between the aluminum mold and the heater material and on top of the heater material to prevent electric shock.

Another alternative includes the use of a gear-motor output shaft which is pressed into a separate cam which then interfaces with the ejector.

Advantages

It may be seen that the above-referenced invention provides advantages over the prior art.

The use of a separate structure and ice mold allows simplification of the ice mold and a corresponding reduction in its mass. The cost will be reduced by eliminating aluminum and by reducing die cast cycle time and tool fabrication and maintenance costs. Part reduction is accomplished by incorporating functions into the structural member.

Another advantage is due to the use of an integral fill cup which requires no additional assembly labor, and provides consistent, accurate positioning of the water tube interface and ejector shaft bearing surfaces.

The provision of the universal mounting configuration allows interfacing of the icemaker with most brands and models of refrigerators.

The provision of the above-discussed control configuration provides reliable operation with less wiring and connections, and uses single-pole-single-throw switches which are less expensive.

The provision of flexible heaters provides even heating in less space, requiring lower wattage. Flexible heaters can be installed on any smooth surface, allowing the ice mold to be stamping or a die casting. Flexible heaters can be safer due to the self regulation of very low wattage in a freezer environment, and due to the availability of self regulating PTC heating inks or wires.

The provision of the above-described ice piece shape does not create a positive interference during ejection of the ice therefore, less heat and/or time for ejection allows for the possibility of heaterless ejection. The curvature of the ice piece is less likely to conform to the side of a drinking glass, reducing the damming effect and the associated nuisance.

Conclusion

While this invention has been described in specific detail with reference to the disclosed embodiments, it will be understood that many variations and modifications may be effected within the spirit and scope of the invention as described in the appended claims.

What is claimed is:

1. An ice making apparatus, comprising:

a) an injection molded icemaker structural member including a mold receiving portion defining an ice mold receiving cavity, said structural member also including an integral stripper member yieldably attached relative to said ice mold receiving cavity along a hinge, said yieldable hinge allowing said stripper member to be moved from an "as-molded" position to an "assembled" position relative to said mold receiving portion; and b) an ice mold capable of being introduced into said ice mold receiving cavity while said stripper member is in said "assembled" position, and configured to capture said stripper member in its "assembled" position.

2. The apparatus as claimed in claim 1, wherein said stripper includes a plurality of locking "hooks" for engaging said ice mold and locking said stripper in said "assembled" position.

3. A method for assembling an ice making apparatus, said method comprising the steps of:

a) injection molding an icemaker structural base such that said icemaker structural base includes a mold receiving portion defining an ice mold receiving cavity and said structural base also includes an integral stripper member yieldably attached relative to said ice mold receiving cavity along a hinge;

b) bending said stripper member along said hinge into an assembled position; and c) introducing an ice mold into said ice mold receiving cavity while said stripper member is in said assembled position, such that said stripper member is at least partially retained in its "assembled" position by said ice mold.

* * * * *

UNITED STATES PATENT AND TRADEMARK OFFICE

CERTIFICATE OF CORRECTION

PATENT NO. : 6,216,471 B1
DATED : April 17, 2001
INVENTOR(S) : Patrick et al.

It is certified that error appears in the above-identified patent and that said Letters Patent is hereby corrected as shown below:

Title page,
Item [56] References Cited, U.S. PATENT DOCUMENTS,

Line 1, "Rundell et al." should read -- Rundell --;
Line 4, "4,679,718" should read -- 4,649,718 --;

Add the following patents:

| | | | |
|---|---|---|---|
| 3,041,844 | 7/1962 | Shaw | 62/135 |
| 3,362,181 | 1/1968 | Linstromberg | 62/135 |
| 4,756,165 | 7/1988 | Chestnut et al. | 62/135 |
| 4,866,948 | 9/1989 | Cole | 62/233 |
| 5,010,738 | 4/1991 | Brown et al. | 62/135 |

Column 9,
Line 8, cancel "yieldable".

Signed and Sealed this

Sixteenth Day of October, 2001

*Attest:*

Nicholas P. Godici

NICHOLAS P. GODICI
*Acting Director of the United States Patent and Trademark Office*

*Attesting Officer*